US008641019B2

(12) United States Patent
Grassmann et al.

(10) Patent No.: US 8,641,019 B2
(45) Date of Patent: Feb. 4, 2014

(54) MIXING DEVICE FOR MIXING WATER AND WATER VAPOR IN A DIVERSION STATION

(75) Inventors: Arne Grassmann, Essen (DE); Christian Musch, Essen (DE); Heinrich Stüer, Haltern (DE)

(73) Assignee: Siemens Aktiengesellschaft, Munich (DE)

( * ) Notice: Subject to any disclaimer, the term of this patent is extended or adjusted under 35 U.S.C. 154(b) by 371 days.

(21) Appl. No.: 13/146,415

(22) PCT Filed: Jan. 8, 2010

(86) PCT No.: PCT/EP2010/050122

§ 371 (c)(1), (2), (4) Date: Jul. 27, 2011

(87) PCT Pub. No.: WO2010/086199

PCT Pub. Date: Aug. 5, 2010

(65) Prior Publication Data

US 2011/0291307 A1 Dec. 1, 2011

(30) Foreign Application Priority Data

Jan. 27, 2009 (EP) ..... 09001085

(51) Int. Cl.
*B01F 3/04* (2006.01)

(52) U.S. Cl.
USPC ..... 261/76; 96/189; 96/363; 55/525

(58) Field of Classification Search
USPC ..... 261/76; 96/189, 363; 55/525
See application file for complete search history.

(56) References Cited

U.S. PATENT DOCUMENTS

| | | | | |
|---|---|---|---|---|
| 3,094,171 | A | 6/1963 | Gagliardo | |
| 3,872,012 | A * | 3/1975 | Endicott | 210/297 |
| 4,830,790 | A | 5/1989 | Stevenson | |
| 2005/0035153 | A1 | 2/2005 | Brown | |

FOREIGN PATENT DOCUMENTS

| | | | |
|---|---|---|---|
| DE | 4122014 | C1 | 5/1992 |
| DE | 19851360 | A1 | 5/2000 |
| DE | 10254569 | A1 | 6/2004 |
| EP | 0467147 | A1 | 1/1992 |
| EP | 0596155 | A1 | 5/1994 |

* cited by examiner

*Primary Examiner* — Robert A Hopkins

(57) ABSTRACT

A diversion station is provided. The diversion station makes it possible to particularly effectively cool diverted water vapor by mixing it with water. The diversion station includes a mixing device, which comprises a so-called static mixer that is substantially made of a wire mesh. The wire mesh is produced by at least one wire that is substantially interlaced into loops. In the intended installation situation, the mixer is installed upstream of a water injection with regard to a flow direction specified by the water vapor such that the mixture of water and water vapor flows through the loops.

6 Claims, 2 Drawing Sheets

MIXING DEVICE FOR MIXING WATER AND WATER VAPOR IN A DIVERSION STATION

CROSS REFERENCE TO RELATED APPLICATIONS

This application is the US National Stage of International Application No. PCT/EP2010/050122, filed Jan. 8, 2010 and claims the benefit thereof. The International Application claims the benefits of European Patent Office application No. 09001085.1 EP filed Jan. 27, 2010. All of the applications are incorporated by reference herein in their entirety.

FIELD OF INVENTION

The invention relates to a device which, in connection with a diversion station, makes it possible to particularly effectively cool diverted water vapor by mixing it with water. According to the invention, a mixing device is provided, which comprises a so-called static mixer that is substantially made of a wire mesh.

BACKGROUND OF INVENTION

In the context of a steam turbine plant, a diversion station serves the purpose, as bypass, of feeding the water vapor formed in a steam generator directly to a condenser past a (steam) turbine. Such a bypass is required, for example, when the running times of steam generator and turbine are not mutually synchronized. By way of example, as early as before the start up of the turbine or still during the shutdown of the turbine, water vapor is generated that cannot be used by the turbine in these operating states.

In order not to damage the condenser when introducing the "unused" water vapor, as a rule in the diversion station the steam pressure is throttled, on the one hand, and the water vapor is cooled by injection of water, on the other hand. The water injected into the water vapor is heated and evaporated, the water vapor conversely being cooled.

In what follows here the term "water" always denotes water in its liquid aggregate state, particularly in drop form, while the term "water vapor" denotes water in its gaseous aggregate state.

The water is frequently injected through a plurality of nozzle stocks aligned transverse to the flow direction and mixed with the water vapor. In an alternative to this, the water is injected into the water vapor in a (single) jet, the mixing usually being implemented by an orifice. It is disadvantageous that comparatively large mixing lengths are required in both variants for mixing—and therefore for successful cooling. In addition, mixing orifices used are subject to relatively high wear from so-called drop impact.

SUMMARY OF INVENTION

It is the object of the invention to specify an apparatus that, in conjunction with a diversion station, enables diverted water vapor to be particularly effectively cooled by mixing with water.

Accordingly, provided as apparatus is a mixing device that comprises a so-called static mixer that is substantially made from a wire mesh. The wire mesh is produced in this case from at least one wire substantially interlaced to form loops. In the intended installed situation, the mixer is mounted downstream of a water injection in such a way with reference to a flow direction prescribed by the water vapor that the loops are flowed through by the mixture of water and water vapor.

The loops are formed substantially by a knitted wire or a wire knitting. The wire mesh is denoted as knitted wire or wire knitting, when the loops are knitted in the literal sense. That is to say, when in a way analogous to knitting in textile technology, the loops are formed by respectively guiding a plurality of loops arranged in a row through a loop of an adjacent row. This lends the wire mesh a particularly high stability. In this case, the wire mesh can, in particular, be fabricated from a single wire.

Here, the term "loop" respectively denotes a wire frame, and an opening enclosed by this wire frame. The designation is used, in particular, irrespective of whether the loop is produced in the narrower sense as a so-called knitted fabric (for example being knitted, crocheted etc.), or whether the loop is produced by another way of linking or interlacing a wire or a plurality of wires.

The term "wire" denotes a thin, longitudinal, flexible piece of metal, in particular having a circular cross section. However, other cross-sectional shapes are also possible in principle.

In a preferred refinement, the wire is fabricated from stainless steel.

Owing to its being produced from wire, the wire mesh differs, in particular, from a perforated sheet, in the case of which a plurality of mostly substantially round openings which are introduced into a sheet.

In the indented installed situation, the loops of the wire mesh are flowed through by the mixture of water drops and water vapor. In this process, the respective wire frames produce vortices which force a transverse mixing of the water vapor flow, and thus a mixing of the water drops with the water vapor. As a result, the water advantageously penetrates to a very large extent to the core of the steam flow. In addition, the water drops are separated on the wire frame, resulting in a quicker evaporation of the water and therefore a more effecting cooling. However, heat is dissipated via the thermally conductive metal owing to the wire mesh. The installation of the mixer made from wire mesh gives an especially effective cooling of the water vapor overall.

By being produced from wire, the mixer has a comparatively high stability, in particular the wire is particularly resistive to tensile loads. In addition, the mixer advantageously has a high thermal endurance.

An additional advantage of the mixer formed from a wire mesh consists in its filter effect: from time to time, during maintenance work on the diversion station it can happen that relatively large parts are forgotten. Said parts can cause greater damage when they pass into the condenser. They are intercepted by the wire mesh should this happen.

In an alternative embodiment, the wire mesh is formed from a wire netting. As netting, the wire mesh is distinguished in that a plurality of wires are respectively substantially interlaced obliquely to one another to form loops. In a further alternative, it is also conceivable to produce the wire mesh as cloth in the case of which a plurality of wires are interwoven to form at least two units. In this case, the wires of one unit are substantially at right angles to the wires of the second unit.

In principle, the mixer can be designed substantially in the form of a round disk that can be mounted in the cross section of a (round) pipeline. In a preferred embodiment, the mixer or its wire mesh is, however, shaped overall substantially as an elliptic paraboloid. In this case, the mesh is intentionally mounted in the pipeline in such a way that it has substantially the shape of a parabola open in the upstream direction in a longitudinal section (with reference to the pipeline). The mesh thereby becomes particularly highly stable against the steam flow.

The wire mesh is preferably dimensioned in such a way that a loop width is selected in relation to the diameter of the wire in such a way that a free flowed-through surface is at least 50% of the total surface of the wire mesh. In this case, the free flowed-through surface is substantially formed by the loop openings, while the total surface is formed both by the loop openings and by the respectively assigned wire frames.

Since the wire frames of the loops of the water vapor flow then advantageously oppose only a comparatively slight cross-sectional surface, on the one hand the pressure loss caused by the installation of the mixer is comparatively slight. On the other hand, the wire frames are also thereby subject to a comparatively slight extent to erosion by drop impact.

BRIEF DESCRIPTION OF THE DRAWINGS

Exemplary embodiments of the invention are explained in more detail below with the aid of a drawing, in which.

DETAILED DESCRIPTION OF INVENTION

Figure 1:
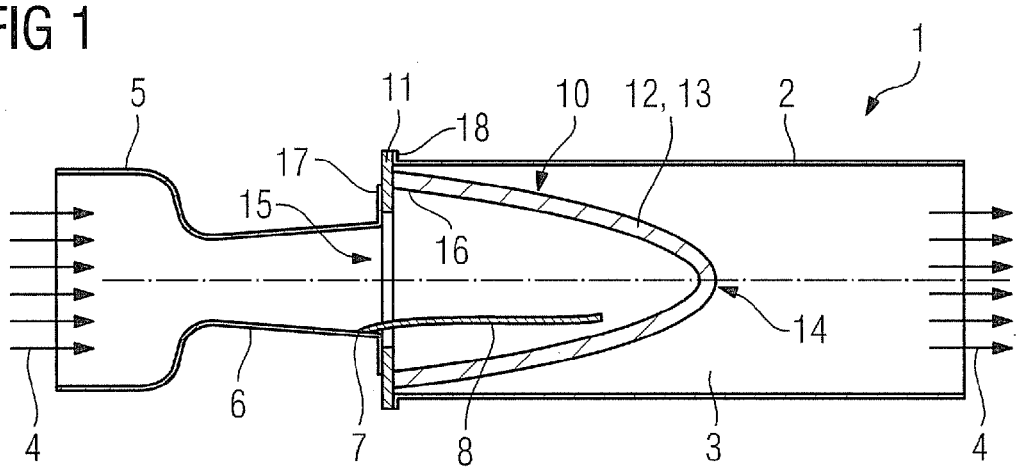
FIG. 1 shows a schematic sectional illustration of a mixing device mounted in a diversion station and having a mixer, formed from a wire mesh, for mixing water and water vapor.

FIG. 1 indicates a part of a diversion station 1 in a highly schematic fashion in longitudinal section. The diversion station 1 comprises a pipeline 2, aligned horizontally here, for transferring water vapor 3, starting from a steam generator (not illustrated here, and arranged on the left of the diversion station 1 in the representation) to a condenser (likewise not illustrated, and to the right of the diversion station). A flow direction 4, indicated by arrows, of the water vapor 3 therefore runs from left to right.

Upward in the flow direction 4, a Laval nozzle 5 is positioned upstream of the pipeline 2 and serves, on the one hand, to throttle the steam pressure and, on the other hand, as a measuring point for the flow rate.

An introduction nozzle 7 for injecting water 8 into the flowing water vapor 3 is arranged in a conically expanding outlet area 6 of the Laval nozzle 5.

The introduced water 8 serves the purpose of cooling down the water vapor 3 before the transfer to the condenser. To this end, the water 8 is mixed with the water vapor 3, the water 8 evaporating. The cooling of the water vapor 3 is performed, on the one hand, by the lower temperature level of the water 8 by comparison with the water vapor 3, and, on the other hand, by taking the evaporation enthalpy absorbed during the evaporation of the water 8 away from the water vapor 3.

In order to improve the mixing of the water 8 with the water vapor 3—and thus for a more effective cooling—a mixing device 10 is mounted in the pipeline 2 in the flow direction 3 downstream of the introduction nozzle 7 or downstream of the Laval nozzle 5.

Figure 2:
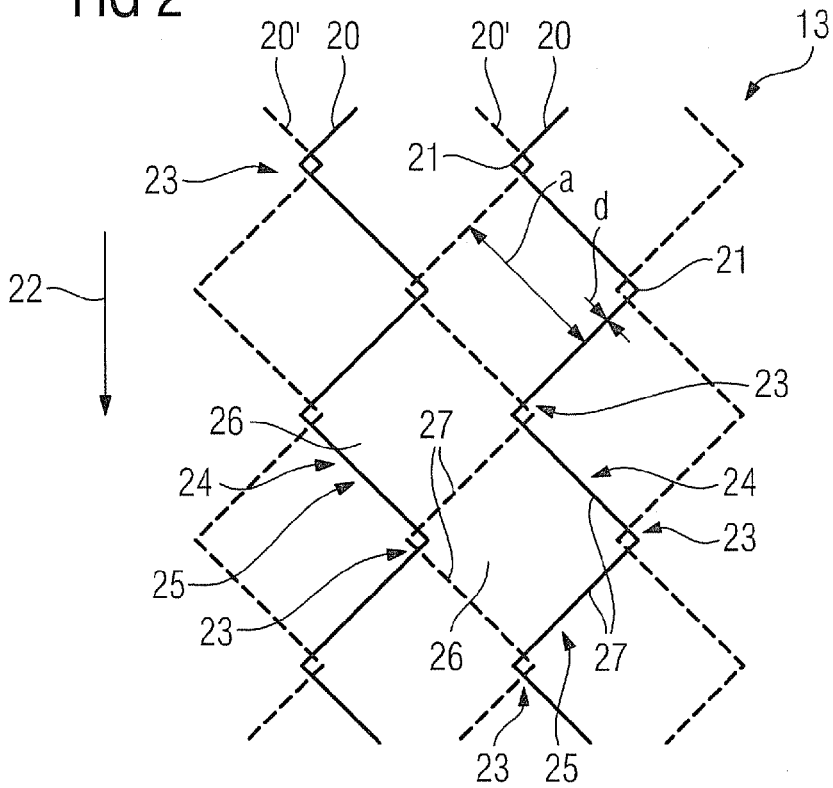
FIG. 2 shows a schematic illustration of the wire mesh in a first embodiment in accordance with FIG. 1, and FIG. 3 and FIG. 4 respectively show the wire mesh in a further embodiment in a representation in accordance with FIG. 2.

In a first embodiment illustrated here, the mixing device 10 comprises, on the one hand, a roughly indicated fastening ring 11 and, on the other hand, a mixer 12, likewise roughly indicated, which is fabricated from a wire mesh 13. The wire mesh 13 is fabricated in the manner of a wire net fence in this embodiment (FIG. 2).

The mixer 12 has approximately the form of an (overdimensioned) thimble or of a rounded hollow cone. The mixer 12 is rounded at its closed end 14. The mixer is mounted, here screwed, on the fastening ring 11 in an approximately concentric fashion with an annular edge 16 facing its open end 15. Here, the fastening ring 11 projects radially beyond the edge 16 radially on both sides.

In a mounted state illustrated here, the fastening ring 11 is mounted between a flange 17 of the Laval nozzle 5 and a flange 18 of the pipeline 2. Here, the mixer 12 is aligned in such a way that its open end 15 faces the introduction nozzle 7 or—approximately in the fashion of a funnel to be filled—faces the flow direction 4.

Vortices are produced in the flow owing to the mesh structure of the mixer 12, thus dictating a mixing transverse to the flow direction 4. In addition, the water 8 present in the flow as drops is separated by the wire mesh 13.

The wire mesh 13 in accordance with the first exemplary embodiment is illustrated partially in FIG. 2 in a greatly enlarged fashion. The wire mesh 13 is illustrated here, in particular, in a prefabricated state in which it spans a plane surface aligned parallel to the plane of the drawing. In order to produce the mixer 12, the wire mesh 13 can then be bent into any desired spatial structure. As an alternative to this, it is also possible to shape the wire mesh 13 as early as when it is being produced into a three-dimensional formation—for example, in the dish-like shape in accordance with FIG. 1.

In FIG. 1, the wire mesh 13 is produced as a wire netting in the manner of a wire net fence. The wire mesh 13 comprises a plurality of (round) wires 20. Each wire 20 is guided in a substantially rectangular, equilateral zig-zag line such that each wire 20 has a multiplicity of corner points 21. Lengthwise, the wires 20 are respectively arranged in a fashion aligned substantially along a longitudinal direction 22 and parallel to one another. In this case, a wire 20 is respectively arranged offset from its adjacent wire 20' in such a way that in each case one of the corner points 21 of the wire 20 makes contact of a sort with one of the corner points 21' of the adjacent wire 20' at a contact point 23. In this case, each wire 20 is respectively interlocked with the wire 20' in the area of the contact point 23. This gives rise to approximately square loops 24. Here, each loop 24 is formed by a wire frame 25 that respectively encloses an opening 26. Each wire frame 25 is defined by four contact points 23, and the sections 27 respectively connecting them, of the wire 20 or of the adjacent wire 20'. The size of each opening 26—the loop width a—is in this case substantially of greater dimension than the diameter d of the wire 20.

In order to obtain such a wire mesh 13, it is possible, in particular, also to guide a single wire 20 substantially in serpentine lines, it then comprising a plurality of sections that, in accordance with the above description, are respectively aligned along the longitudinal direction 22 in zig-zag lines, in a fashion substantially parallel to one another, and are interlocked with one another to form loops 24.

In an alternative embodiment, it is also possible for each wire 20 to be twisted with the adjacent wire 20' at the contact points 23. This respectively lends the loops 24 an essentially hexagonal shape (as frequently employed in the case of "hare fence"). In a further alternative, it is also conceivable for the two adjacent wires 20 and 20' to be knotted with one another at the contact points 23 in a manner of a fishing net. Two alternative embodiments are distinguished by a particularly high dimensional stability of the loops 24.

Figure 3:
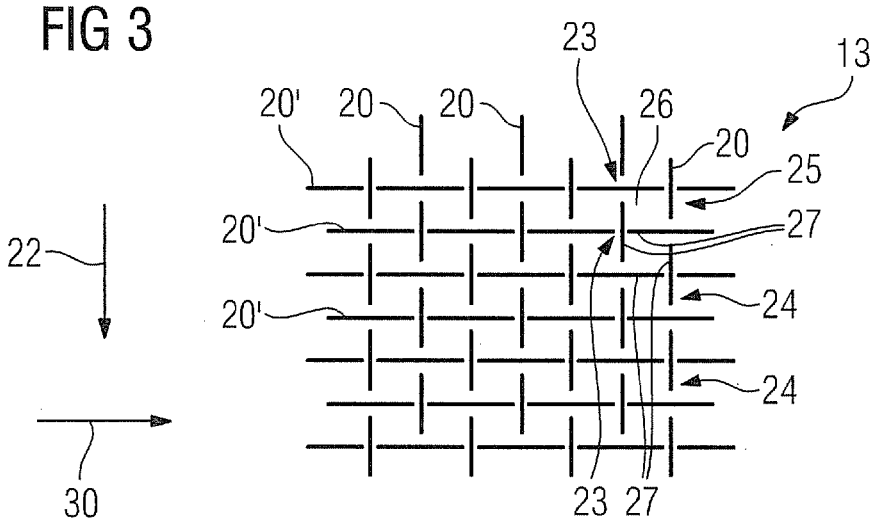

The wire mesh 13 in the prefabricated state in accordance with FIG. 2 is shown in a second embodiment in FIG. 3. In this embodiment, the wire mesh 13 is formed by a wire cloth (a flat one here). In turn in this case, a multiplicity of the wires 20 are aligned—rather like warp wires—parallel to one another in the longitudinal direction 22, while on the other hand a multiplicity of the wires 20' are aligned, as it were as weft wires, parallel in turn to one another in a transverse direction 30, approximately at right angles to the wires 20. In this case, each wire 20' is interwoven with the wires 20 in a transverse direction 30 by being guided alternately once over a wire 20 and once under a wire 20 adjacent thereto. In the illustrated embodiment, all the wires 20 and 20' are arranged in each case at the same spacing from one another so that substantially square loops 24 are formed here.

In this case, each wire frame 25 is defined in turn by four contact points 23 at which a wire 20 and a wire 20' respectively cross, and by the sections 27 respectively connecting said wires.

In a departure from the distribution illustrated here, an irregular distribution of the wires 20, 20' is also conceivable. An asymmetric "web pattern" is also possible. For example, each wire 20' can alternately respectively be guided over two wires 20 and in an adjacent fashion under a wire 20.

Figure 4:
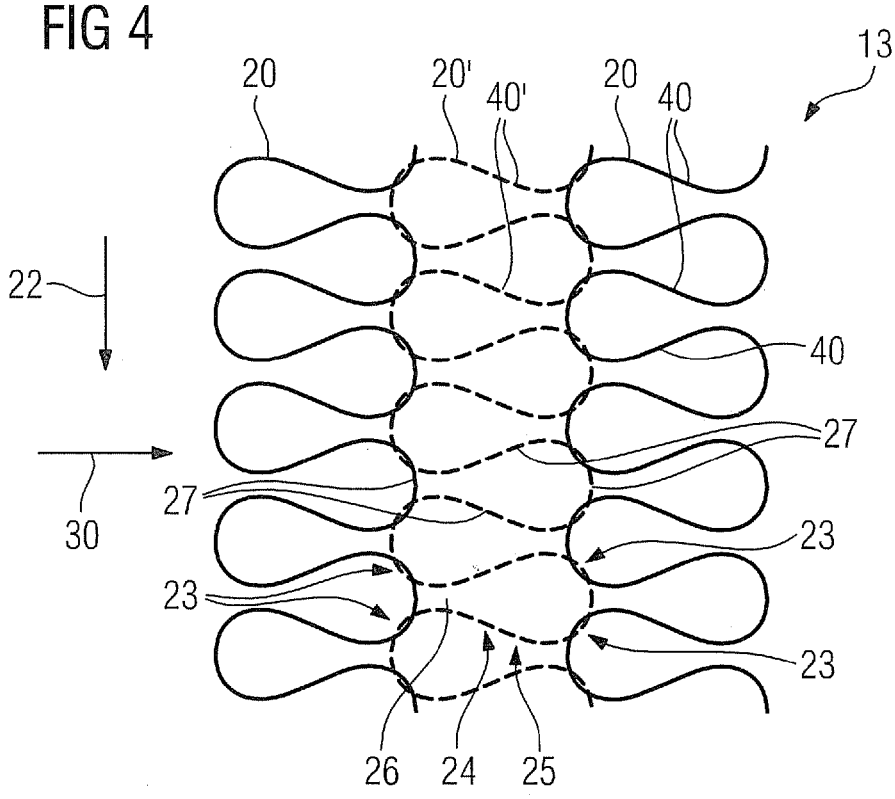

In FIG. 4, the wire mesh 13 is designed in turn as a knitted wire in the prefabricated state in accordance with FIG. 2. In a way similar to the first embodiment, each wire 20 here is guided in a meandering shape, a multiplicity of loops 40 being arranged next to one another in a longitudinal direction 22. In a way analogous to the embodiment from FIG. 1, the wires 20 are aligned in this case in a fashion substantially parallel to one another overall, a wire 20 respectively being adjacent to a wire 20'.

Each loop 40' of one wire 20' in this case hooks into an adjacent loop 40 of the wire 20 such that a multiplicity of loops 24 result in turn. Each loop 24 is largely formed in this case by one of the loops 40 or 40'. Here, the wire frame 25 of each loop 24 is formed in turn by four contact points 23 (at which the wire 20' is respectively interlaced with one of the wires 20 adjacent on both sides in a transverse direction 30) and the section 27 connecting said loops. In a way analogous to the embodiment in accordance with FIG. 2, it is also possible here for the knitted wire to be formed from a single wire 20—that is guided appropriately.

The invention claimed is:

1. A diversion station, comprising:

a mixing device for mixing water and water vapor in a diversion station, comprising:

a static mixer that is substantially made from a wire mesh, wherein the wire mesh is fabricated from a wire substantially interlaced to form a plurality of loops, wherein the mixer is mounted downstream of a water injection in such a way that the plurality of loops are flowed through by the mixture of water and water vapor, wherein the plurality of loops substantially are formed by a knitted wire or wire knitting, and wherein a Laval nozzle is arranged upstream of the mixing device.

2. The diversion station as claimed in claim 1, wherein the mixer substantially spans a surface of an elliptic paraboloid.

3. The diversion station as claimed in claim 1, wherein the wire mesh substantially spans a surface of an elliptic paraboloid.

4. The diversion station as claimed in claim 1, wherein the wire is fabricated from stainless steel.

5. The diversion station as claimed in claim 1, wherein the wire includes a circular cross section.

6. The diversion station as claimed in claim 1, wherein a ratio of a loop width to a wire diameter is dimensioned in such a way that a free flowed-through surface is at least 50% of a total surface of the wire mesh.

* * * * *